United States Patent [19]

Weller

[11] Patent Number: 4,464,058

[45] Date of Patent: Aug. 7, 1984

[54] WORLD TIME AND DAY INDICATOR CLOCK

[76] Inventor: Barton L. Weller, Box 68, Monroe, Conn. 06468

[21] Appl. No.: 427,602

[22] Filed: Sep. 29, 1982

[51] Int. Cl.[3] ..... G04B 19/26

[52] U.S. Cl. ..... 368/21; 368/23; 368/24

[58] Field of Search ..... 368/21–24

[56] References Cited

U.S. PATENT DOCUMENTS

| | | | |
|---|---|---|---|
| 536,504 | 3/1895 | Arriga | 368/21 |
| 694,256 | 2/1902 | Day | 368/23 |
| 2,603,940 | 7/1952 | Packard | 368/24 |
| 2,721,442 | 6/1952 | Pettigrew, Sr. | 368/23 |
| 3,091,915 | 6/1963 | Pawl | 368/24 |

FOREIGN PATENT DOCUMENTS

| | | | |
|---|---|---|---|
| 676613 | 11/1916 | Italy | 368/21 |
| 133682 | 1/1946 | Sweden | 368/23 |

*Primary Examiner*—Bernard Roskoski
*Attorney, Agent, or Firm*—Thomas L. Tully

[57] ABSTRACT

A novel twenty-four hour clock providing a continuous display representative of the rotation of the Earth relative to the heavens, and the changing position of illustrated geographic areas of the Earth relative to the fixed position of the Sun, thereby providing the viewer with a visual display of the local time of day and also the time of day in each of said geographic areas. The present clock also includes a fixed midnight mark representative of a location in the heavens, 180° around the Earth from the fixed location of the Sun, coinciding with the occurrence of midnight at each geographic area of the Earth as said geographic area passes thereby, the geographic area in which the Fiji Islands and New Zealand are located being designated the International Date Line. The present clock is characterized by the presence of a progressing day-indicating means which provides a clear visual representation of the geographic portions of the Earth experiencing the new day and the old day as concurrently experienced in different geographic areas of the Earth, thereby providing the viewer with a clear visual indication and, if desired, digital identification of the local time and calendar day and the time and calendar day in all geographic areas of the Earth.

17 Claims, 6 Drawing Figures

WORLD TIME AND DAY INDICATOR CLOCK

BACKGROUND OF THE INVENTION

Twenty-four hour clocks are in current use, particularly in the aviation and military fields. Such clocks have a circular dial or face which is divided into arc points spaced by 15° from each other around the dial to provide a total of twenty-four points, each representing an hour of the day. Generally, the top location, corresponding to the hour "12" on a twelve-hour clock, is designated as "0" or "24" on a twenty-four hour clock dial, with the numbers "1" through "23" progressing clockwise.

Such clocks have an hour hand, a minute hand and a second hand, which make one complete revolution each twenty-four hours, each 60 minutes and each 60 seconds, respectively. The hour hand may comprise a geographic radiant or disk which may include a local hour hand which is adjustable relative thereto to indicate the local hour time and the concurrent hour time in a plurality of continents illustrating geographic areas of the World. The minutes and seconds indicated by the other hands are universal.

Realizing the relationship between the rotation of the hour hand of a twenty-four hour clock and the rotation of the Earth relative to the Sun, it has been proposed to provide a twenty-four hour clock having a geographic disk or radiant, corresponding to the Southern Hemisphere, which rotates with the hour hand and thus provides a visual indication of the changing location of any or all of the continents of the Earth relative to the axis of rotation of the Earth and to the fixed position of the Sun, and a visual indication of the local time in each of said geograhical areas. If a Northern Hemisphere radiant was illustrated, the clock would be required to rotate in the unconventional counterclockwise direction. Hence, the Southern Hemisphere is illustrated, to coincide with the true clockwise rotation of the Earth relative to the Sun.

Reference is made to U.S. Pat. No. 694,256 which discloses a twenty-four hour clock which provides the viewer with a visual indication of the local time of day, shown by the position of the hour hand, and with a simultaneous visual indication of the concurrent time of day in each of the geographic areas shown on the geographic radiant or disk, indicated by the position of said geographic areas, relative to the location of the Sun which is pictured in fixed position on the dial face at the 1200 hour position (noon or prime meridian). The other twenty three hour positions, or alternate even-hour positions, are also indicated around the outer periphery of the dial face, each hour position being spaced from the next by 15° increments. This conforms the clock face to a hemisphere of the Earth which, by international agreement has been divided into twenty-four time zones of 15° longitude each. Greenwich, England has been designated time zone zero and is the Prime Meridian. Therefore, the Earth latitude which is positioned 180° latitude from Greenwich, i.e., the Fiji Islands, New Zealand and the Bering Straights, is designated as the International Date Line. At Prime Meridian Greenwich is directly under the Sun, or at noon. This is the only instant of each twenty-four hour period in which the entire Earth is experiencing the same day or calendar date. However, the next second brings a new day or calendar date in the International Date Line time zone so that different portions of the Earth are simultaneously experiencing two different days or calendar dates.

Conventional twenty-four hour clocks are useful in the aviation and military fields for providing a universal reference for time, i.e., Greenwich Mean Time. Also, such clocks are very desirable for people who travel around the World frequently and/or who are in frequent contact with people in various other parts of the World, such as business people with business associates or companies located around the World. Thus, it is useful or necessary to be aware of the time of day in other parts of the World before attempting to make an international telephone call or before making airplane reservations or other commitments which can be more effectively carried out if planned to coincide with certain local hours and dates in other parts of the World.

However, conventional twenty-four hour clocks have at least one important limitation with respect to the visual display of World-wide time. As mentioned supra, a twenty-four hour clock encompasses two different calendar days at all times except at the instant when noon occurs at the Prime Meridian, i.e., in the Greenwich time zone, and midnight occurs concurrently at the International Date Line, time zone 12, 180° latitude from Greenwich. Thus, while a twenty-four hour clock provides a quick visual indication of the time of day in other continents on Earth, it does not include any means for providing a quick visual indication of those portions of the Earth experiencing the same day as the local day and those portions of the Earth experiencing a different day. Such information is important in connection with the making of business telephone calls on a Friday or a Monday to parts of the World where it may not be a business day, i.e., Saturday or Sunday. Such information is also important in connection with meeting date deadlines, expiration dates and other commitments where the first or last days of a month or year may be critical.

SUMMARY OF THE INVENTION

The present invention relates to a novel twenty-four hour date clock which not only provides a quick visual indication of the local time of day and the time of day in other international time zones or geographic areas but which also provides a quick visual indication of the day of the week in the local area, the portion of the Earth which is experiencing the same day of the week and the portion of the Earth which is experiencing a different day of the week, relative to the local day.

According to a preferred embodiment of the invention, the present World clock comprises a dial illustrating at least some of the 24 hour positions of a 24-hour clock, including the 24 hour or midnight position, an hour hand comprising a geographic radiant carrying an International Date Line mark and representations of at least some of the geographic areas of the Earth in correct geographic relation to each other and to the center of rotation of the radiant, and a day-indicating means which advances or progresses in alignment with the International Date Line mark and with the rotation of the radiant, starting at the midnight mark on the dial, to provide a continuous, clear visual background indication of the portions of the Earth represented on the radiant which are experiencing the new day as opposed to the other portions of the Earth represented on the radiant which have a visually-distinct background and are still experiencing the old day. The display can also comprise a digital display of the calendar dates, alone, or in combination with identification of the day and/or month and/or year.

DETAILED DESCRIPTION

Figure 1:
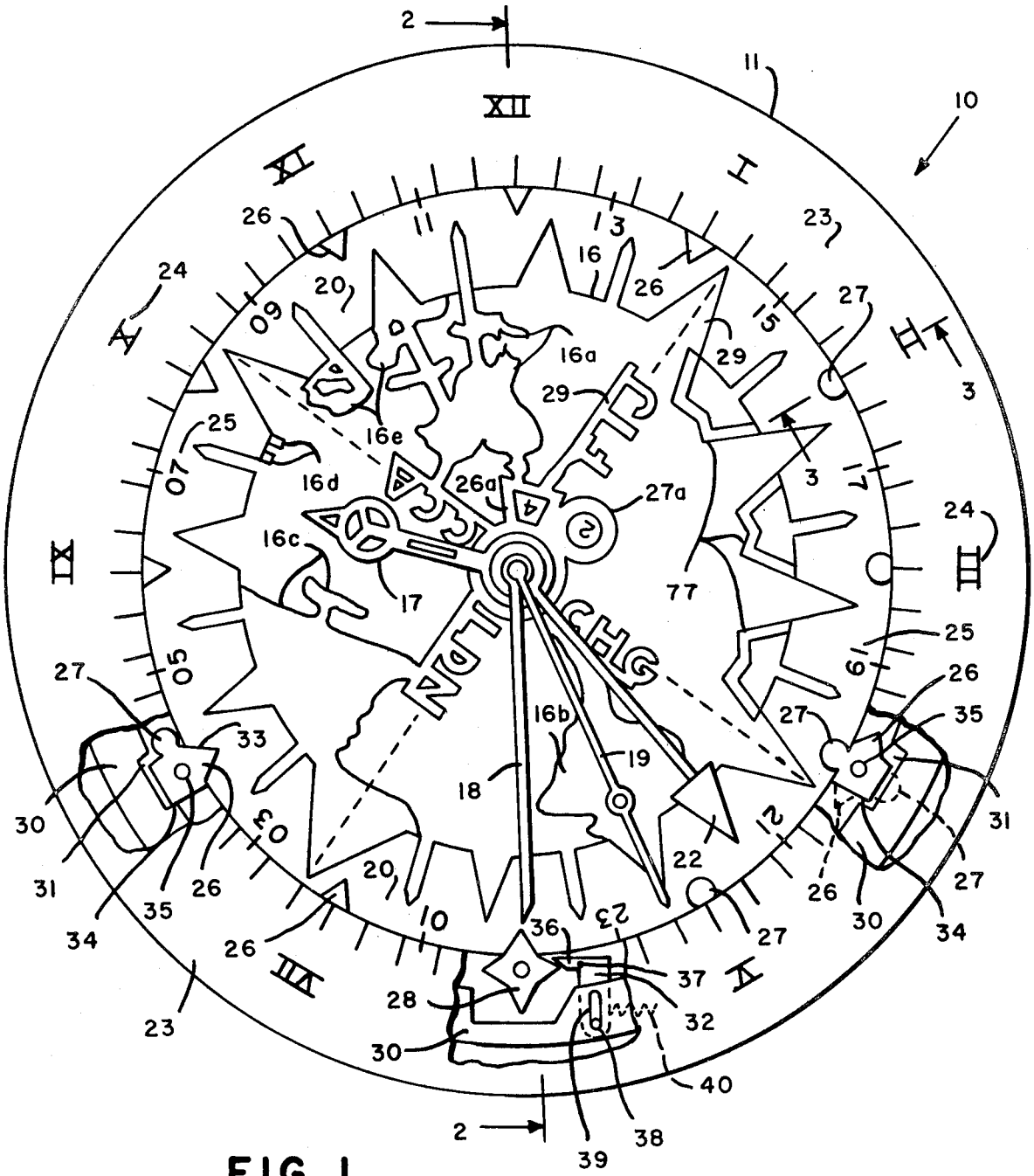
FIG. 1 is a front view of a twenty-four hour clock according to one embodiment of the present invention incorporating a plurality of day-indicating elements.
Figure 2:
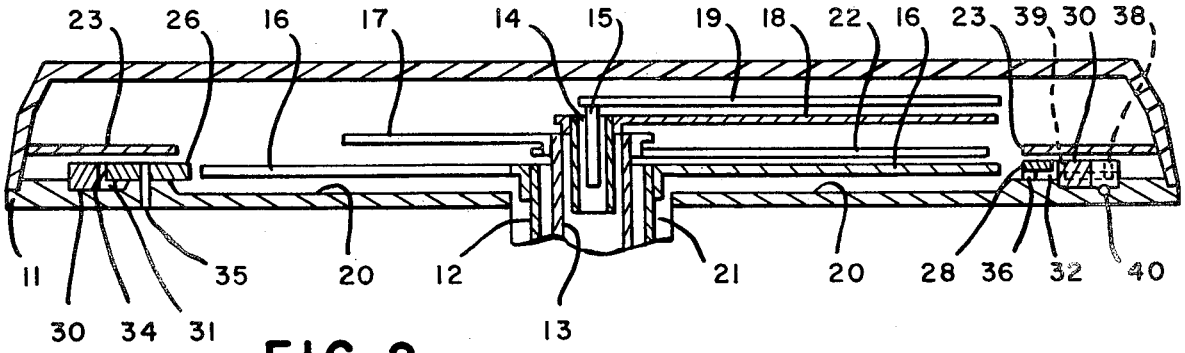
FIG. 2 is a cross-section of the clock of FIG. 1 taken along the line 2—2 thereof.

FIGS. 1 and 2 illustrate the front view and cross-sectional view, respectively, of the face of a novel twenty-four hour clock according to a preferred embodiment of the present invention, the term "clock" being used generically throughout the present disclosure and claims to include timepieces of all types and sizes such as mechanical and electrical wall clocks, desk clocks, wristwatches, pocket watches, or the like. Since the internal chronometer mechanism for twenty-four hour clocks having three hands or radiants which make one complete revolution each twenty-four hours (hour hand), each hour (minute hand) and each minute (second hand), respectively, are well-known, such mechanism is not illustrated by the present drawings which only illustrate the novel features of the face elements of the present clocks.

The embodiment of FIGS. 1 and 2 comprises a preferred clock which incorporates both a conventional twelve-hour mechanism and display and also a conventional twenty-four hour mechanism and display, the latter being further characterized by a progressing display of the areas of the Earth which are experiencing the new day and the areas of the Earth which are experiencing the old day.

The clock 10 of FIGS. 1 and 2 comprises a casing 11 which contains the chronometer mechanism or works (not shown) which controls the relative movement of the coaxial sleeves 12, 13, 14 and 15 to which the geographic radiant 16, the twelve-hour hand 17, the minute hand 18 and the second hand 19, respectively, are attached. The coaxial sleeves extend into the casing 11 through a central opening 21 in the dial face 20 for engagement with the respective coaxial drive shafts or arbors of the works. The illustrated clock also contains a local geographic pointer 22 which is adjustably frictionally attached to the coaxial sleeve 12, overlying the radiant 16, so as to be manually positionable in any radial direction, relative to the radiant, to point to the local geographic area of the viewer. In the embodiment shown in FIG. 1, the pointer 22 is positioned to indicate the local time zone of the eastern United States, one hour ahead of the CHG or Chicago time pointer of the radiant 16.

The clock 10 of FIGS. 1 and 2 also includes an annular 12-hour ring 23 which is spaced above the dial face 20 around the outer periphery thereof and which carries twelve, evenly-spaced numbers 24, shown as Roman numerals I through XII. Ring 23 in association with the 12-hour hand 17 and the universal minute hand 18 and second hand 19 provides a conventional 12-hour clock which displays the local time without any indication of whether it is ante meridian or post meridian. In the embodiment illustrated by FIG. 1 the 12-hour display indicates the local time to be 9:29:26.

The twenty-four hour display of the clock of FIG. 1 further indicates the local time to be 9:29:26 post meridian, i.e., 21:29:26. The dial face 20 is provided with alternate twenty-four hour numbers 25 and day elements 26 and 27 which, in association with the geographic radiant 16, the local geographic hand 22 and the universal minute hand 18 and second hand 19, provide a conventional twenty-four hour clock which displays the local time as 21:29:26 (9:29:26 PM) and also displays the concurrent time around the Earth, i.e., 2:29:26 LDN or London time (Greenwich Mean Time), 8:29:26 CCA or Calcutta, India time, 14:29:26 FIJI or Fiji time (International Date Line) and 20:29:26 CHG or Chicago time. In addition, the novel clocks of the present invention also provide a clear visual indication, in the form of the "new" day symbols 27, as to which geographic areas of the Earth, represented or identified on the radiant 16, are experiencing the "new" day and which are still experiencing the "old" day. Referring to FIG. 1, it will be noted that the "new" day triangular symbols 26 are exposed from the star gear 28, representing the midnight mark on the dial face 20, clockwise to the symbol 26 representing the fourteenth hour, i.e., 14:29:26 or 2:29:26 P.M. Fiji time of the new day. Also, it will be noted that the "old" day circular symbols 27 are exposed from the star gear 28 counterclockwise to the symbol 27 representing the sixteenth hour on the dial face 20. Preferably, as illustrated in FIG. 1, the Fiji pointer 29, which extends radially outwardly to a greater extent than any other portion of the radiant 16, has associated therewith companion new day symbol **26*a* and old day symbol 27*a* to more specifically identify the point of departure between the new day and the old day, i.e., clockwise and counterclockwise, respectively, from the exposed pointer of the star gear 28 to the Fiji pointer 29**.

The concurrent time and the day of each of the geographic areas illustrated on the radiant 16 of FIG. 1 is clearly apparent from a quick visual inspection of the clock 10. The areas illustrated on the radiant 16 in addition to Fiji, Chicago, London and Calcutta, are Australia and New Guinea (**16*a*), South America (16*b*), Africa and Malagasy Republic (16*c*), India and Syrilanka (16*d*), Sumatra and Borneo (16*e*). Northern Hemisphere geographic areas and times can also be interpolated by means of an awareness of the corresponding latitude and time zones in the Northern and Southern Hemispheres. For example, the western half of South America is in the same latitude and time zone as the eastern portion of the United States. Thus, the local hour hand 22 and the minute and second hands of the twenty-four hour display indicates the time in New York to be 21:29:26 (9:29:26 P.M.) and the nearest clockwise symbol 27 indicates that it is still the "old" day in New York. Also, the optional twelve hour display on ring 23 associated with the twelve hour hand 17 and the universal minute and second hands 18 and 19 indicates the same time, i.e., 9:29:26. However, cross-reference to the twenty-four hour display is necessary to identify the time as post meridian and to identify the local day as the old day. The local hands 17 and 22** are manually adjustable to any desired radial direction so as to identify the local time in any desired geographic area of the Earth.

The most essential feature of the novel clock of FIGS. 1 and 2 is the progressing day-indicating means which provides a clear visual indication of the change of day in the various illustrated geographic areas of the Earth and a clear visual indication of those illustrated geographic areas which are concurrently experiencing the new day and the old day.

In the embodiment of FIGS. 1 and 2 a mechanical means for producing this result is concealed beneath the annular twelve-hour dial ring 23 which is spaced slightly above the plane of the twenty-four hour dial face 20. Such means comprises an annular cam ring 30 which is rotatably mounted beneath the dial ring 30 and which is provided with a plurality of uniform cam recesses 31 and with a lever 32 which is spring biased to hold the cam ring 30 in one position, to permit the cam ring 30 to be rotated to a second position and to return the cam ring 30 to the said one position for purposes which are to be explained.

The cam ring cooperates with a plurality of unitary day-indicating members 33, each having a new day symbol 26, an old day symbol 27, an engagement wall 34 and a pivot point 35 by which it is rotatably attached to the dial face 20 beneath the dial ring 23. As illustrated, each day-indicating member 33 is attached to the dial face 20 at a location corresponding to the presence of a cam recess 31 in the cam ring 30 so that the engagement wall 34 of each member 33 extends into the adjacent recess 31 of the cam ring 30 when the member 33 is rotated about its pivot 35 from the old day position, in which the circular symbol 27 extends out from under the dial ring 23 as the only visible portion of the member 33, to the new day position, in which the triangular symbol 26 extends out from under the dial ring as the only visible portion of member 33. In the old day position, shown by the sectional view of the member 33 at the twentieth hour position of FIG. 1, no portion of the member 33 extends within the recess 31 of the cam ring 30 and therefore, each member 33 can be rotated into the new day position by engagement of the Fiji pointer 29 with the old day symbol 27 without any interference with the cam ring 30. This permits the Fiji pointer 29, corresponding to the geographic location of the International Date Line, to change the visual display of each day-indicating member overtaken by the pointer 29 from the old day symbol 27 to the new day symbol 26, providing a clear visual indication of the end of the old day and the start of the new day in the geographic areas of the Earth illustrated on the radiant 16 as said areas are rotated past the star gear 28 or midnight position on the dial face 20.

When the Fiji pointer 29 is rotated around to the midnight position, all of the new day symbols 26 are exposed to indicate that the entire Earth is experiencing the same day. However, as the Fiji pointer 29 moves through the midnight position, it engages the projecting point of the star gear 28 to cause gear 28 to rotate and engage the trip arm 36 of lever 32. Lever 32 pivots on pin 37 to cause the cam ring 30 to rotate clockwise, by engagement of a pin 38 on the lever 32 within a slot 39 on the cam ring 30. Such rotation of ring 32 causes engagement between the ring 30 and the engagement wall 34 of each of the members 33, due to the extension of each wall 34 into its associated ring recess 31, thereby causing each of the day-indicating members 33 to be rotated clockwise about its pivot 35 to re-expose all of the old-day symbols 27. When the star gear 28 rotates out of engagement with the trip arm 36 of lever 32, lever 32 is returned by spring 40 to retract the ring gear 30 to its original position. The continuing clockwise rotation of the Fiji pointer 29 of the radiant 16 beyond the midnight mark of the dial begins to define another new day from the exposed pointer of the star gear 28 clockwise to the pointer 29, the contact between the pointer 29 and each of the exposed old day symbols 27 overtaken by the pointer 29 causing each of the day-indicating members 33 to be rotated or tripped in the counterclockwise direction about its pivot 35 to shield the old day symbol 27 and expose the new day symbol 26.

In the alternative, it will be clear to those skilled in the art that the day-indicating pivot members 34 may comprise rotating members having two opposed day symbols 26 and two opposed day symbols 27, as shown by means of broken lines in FIG. 1, so that each quarter-rotation of each member 34 by the Fiji pointer 29 causes an alternate day symbol, 26 or 27, to become exposed and to remain exposed for a complete revolution of the radiant 16. Just before midnight, Fiji time, all identical symbols, 26 or 27, are exposed. Movement of the Fiji pointer 29 past the twenty-four hour position on the dial causes a different symbol, 26 or 27, to become exposed to illustrate the new day. This avoids the need for the cam ring 30 and the star gear 28 and the re-set mechanism of FIGS. 1 and 2.

Figure 3:
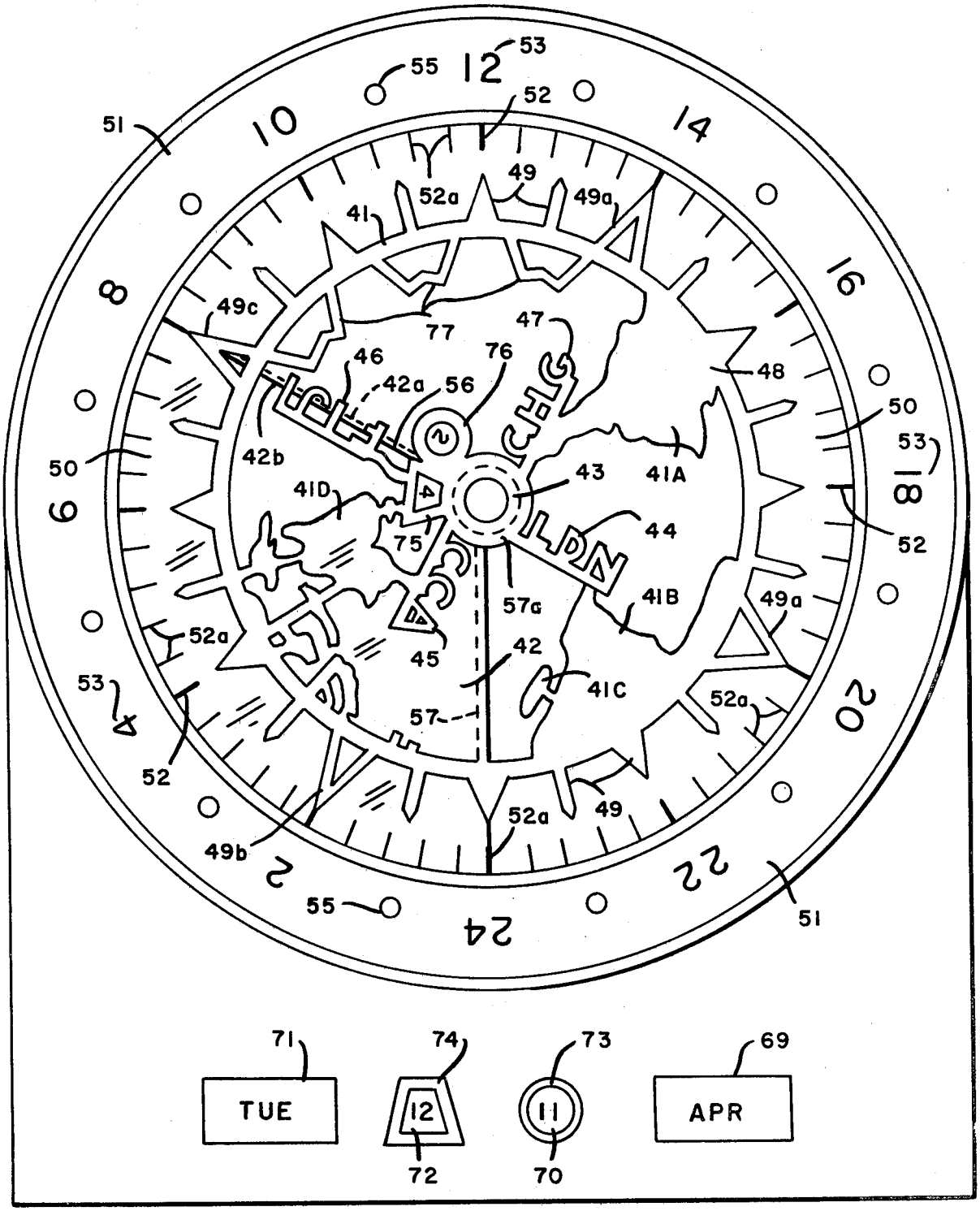
FIG. 3 is a front view of a twenty-four hour clock according to another embodiment of the present invention, incorporating a rotating disk day-indicator.

FIG. 3 illustrates another embodiment, in which the radiant 41 or hemisphere disk and a day-indicating disk 42 are both attached in spaced relation to the sleeve of the clock works which makes one revolution each twenty-four hours, moving the radiant 41 and the disk 42 as a part thereof. In the embodiment or design for the radiant 41 shown in FIG. 3, the radiant comprises a central ring 43 having a center of rotation corresponding to the axis of rotation of the Earth, four equally-and geometrically-spaced integral radial support extensions 44, 45, 46 and 47 and an integral annular peripheral continent ring 48 which comprises visually recognizable shapes 41A, B, C and D of portions of the major continents of the Southerm Hemisphere as they would be viewed from a point in space below the South Pole, shown in accurate geographic location relative to each other and to the axis of rotation. The continent ring 48 also comprises a plurality of twenty-four radial pointers 49 which are uniformly spaced 15° from each other in one-hour increments, relative to the hour indicia on the dial 50 and on the annular hour ring 51. Pointers 49*a, b, c* and *d* on each of the radial extensions 44 to 47 are illustrated with different shapes. As illustrated, the latter extensions contain abbreviations of the names of the major cities—London, Chicago and Calcutta, with the fourth extension 46 being marked Fiji, representing the International Date Line. LDN extension 44 carries a dominant pointer 49*a*, representative of the coincidence between London time and Greenwich Mean Time, and the Fiji or Date Line pointer 49*c* of extension 46 extends in a direction 180° from the London extension 44, representative of the 12-hour time difference between countries in the Greenwich time zone and countries in the International Date Line time zone, such as the Fiji Islands and New Zealand. At the instant Prime Meridian or Greenwich time zone is at noon, a day ends and a new day begins in the International Date Line zone.

A local hour hand or pointer may be adjustably and frictionally attached to the radiant 41 for rotation therewith, as shown in FIG. 1. This permits the local hour hand to be positioned on the radiant 41 to point to any desired time zone such as the time zone in which the viewer resides.

The clock dial 50 illustrated by FIG. 3 comprises a plurality of twelve alternate bold hour marks 52, each of which is aligned with an alternate even-hour number 53 present on the hour ring 51, the odd hours between said numbers 53 being designated by indicia 55 on the ring 51. Between each pair of hour marks 53 on the dial 50 are four evenly-spaced minute marks 52*a* which, together with the hour marks 52, comprise sixty evenly-spaced marks representative of the sixty minutes of each hour and the sixty seconds of each minute. Thus, with respect to reading the time in seconds and minutes, as indicated by the position of the second hand and the minute hand, respectively, the distance between adjacent minute marks 52*a* indicates one second or one minute, and the distance between adjacent hour marks 52 indicates five seconds or five minutes. When reading the time in hours, as indicated by the position of the pointers 49 of the radiant 41 which indicate the current hour in World continents and cities exemplified on the radiant 41, or as indicated by the local hour hand which indicates the local hour, the 6° arc between adjacent minute marks 52*a* indicates a difference of twenty-four minutes relative to the hour hand. The radiant 41 of FIG. 3 provides the viewer with a visual illustration of the current time in all sections of the World, geographic area 41A representing South America in which the current time is the same as, or one or two hours later than, Eastern Standard Time in the western, central and eastern portions thereof, respectively. Geographic area 41B represents Africa, area 41C represents the Maligasy Republic and 41D represents Australia. Also, the radiant extensions 44, 45, 46 and 47 designate specific geographic locations, the FIJI extension 46 designating the Fiji Islands and New Zealand.

It should be understood that the geographic hand member or radiant 41 can be customized to suit the needs of the particular user by illustrating and/or naming geographic areas or cities which are of particular interest. For example, a corporation with branches or business affiliates in Los Angeles, New York, Lisbon and Tokyo could have a clock designed to include specific radiant extensions which name and point to those areas of the World, and/or a radiant which illustrates the geographic areas in which those cities are located even though such cities are located in the Northern Hemisphere.

Figure 4:
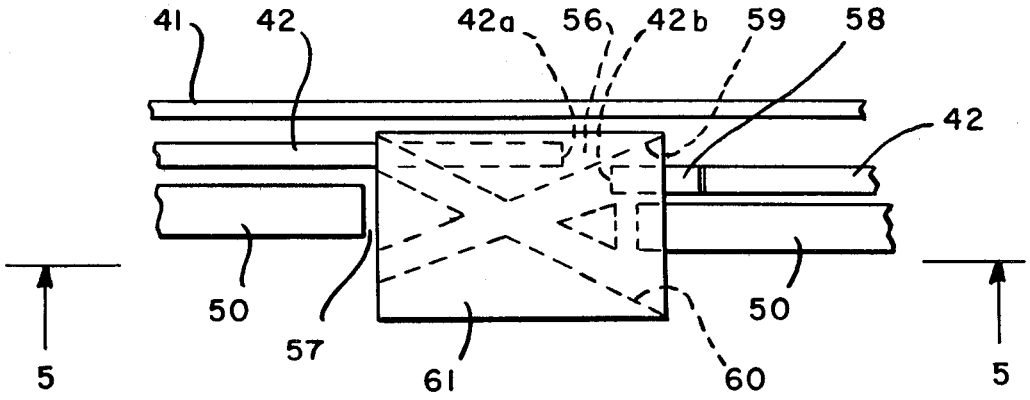
FIG. 4 is a cross-sectional view illustrating one means for causing the rotating day-indicating disk to move inwardly and outwardly of the dial face on alternate revolutions.
Figure 5:
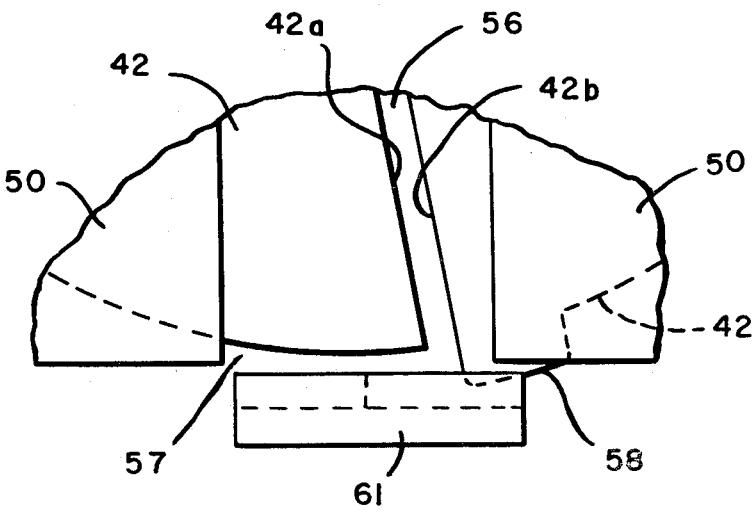
FIG. 5 is a view taken along the line 5—5 of FIG. 4.

An essential feature of the day-indicating clock of FIGS. 3 to 5 is the flexible day-indicating disk 42 which is fixed to the 24-hour shaft in spaced relation to the geographic radiant 42 and which is provided with a radial slot 56 in the area corresponding to the International Date Line of the geographic radiant 42. Slot 56 cooperates with the radial dial slot 57 at the 24-hour or midnight position on the dial face 50 and with the central dial opening 57*a* to cause the day-indicating disk 42 to rotate into position in front of and behind the dial face 50 during successive revolutions to provide a visual indication of the areas of the Earth, represented on the geographic radiant, which are experiencing the same day and the other areas which are experiencing a different day.

The mechanism for causing the disk 42 to move behind or in front of the dial face 50 during successive rotations may be as illustrated in U.S. Pat. No. 2,011,517. However, FIGS. 4 and 5 illustrate a similar mechanism in which the day-indicating disk 42, having radial slot 56, is provided with a tab extension 58 which extends radially beyond the periphery of the disk 42 for engagement with the inwardly tapered walls 59 and 60 of a guide member 61. As can be seen from FIG. 4, each successive revolution of the day-indicating disk 42 causes the tab extension 58 to be engaged by wall 58 or 59, on alternate revolutions, thereby causing the trailing end 42*b* of disk 42 to be flexed into and out of dial slot 57, respectively. FIG. 4 illustrates the end 42*b* of disk 42 being flexed into the slot 57 so that during its next revolution, starting from the International Date Line, it will become concealed behind the dial face 50. FIG. 3 illustrates the day-indicating disk 42 exposed from the dial slot 57, at the 24-hour position on the dial face 50, to the 8-hour position on the dial face 50, thereby providing a continuous visual background indication of the geographic areas present on the corresponding area of the semi-transparent geographic radiant 41 which are experiencing the new day and also indicating the time of the day in said geographic areas, i.e., 8:00 A.M. in the Fiji Islands; 2:00 A.M. in Calcutta, etc. The radiant 41 is transparent in the areas between the illustrated geographic land masses 41A, B, C and D.

During the next revolution of the day-indicating disk 42 the background color contrast will be reversed since the trailing edge 42*b* of the colored disk 42 will be flexed behind the dial face 50 when it reaches the dial slot 57, as shown by FIGS. 4 and 5, and the next new day will begin to appear as an exposure of the dial face 50 as the leading edge 42*a* of the day-indicating disk 42 moves over the dial face 50, gradually exposing more thereof, until it reaches the dial slot 57. Since the rest of the disk 42 is behind the dial face 50 at this point, the leading edge 42*a* of the disk 42 will flex into the slot 57 while the trailing edge 42*b* of the disk 42 is again deflected, by engagement of the tab extension 58 with the guide wall 60, out of the dial slot 57 into position overlying the dial face 50 for the next revolution, as shown by FIGS. 4 and 5.

The background or dial face 50 of FIG. 3 represents the "old" day, such as Apr. 11, 1981, which is still being experienced in the geographic areas of the Earth illustrated within the portion of the radiant 41 between the 24-hour or midnight mark 52*a* on the ring 51 counterclockwise to the trailing edge 42*b* of the day-indicator disk 42. At the same time, the exposed portion of the disk 42, visible behind and through the radiant 41, represents the "new" day, such as Apr. 12, 1981, which is concurrently being experienced in the geographic areas of the World which are illustrated within the portion of the radiant 42 between the midnight mark 52*a* at the dial slot 57 clockwise to the trailing edge 42*b* of disk 42 at the Date Line extension 46 of radiant 41. Thus, a quick view of the clock illustrates not only the current time in all parts of the Earth but also the areas of the Earth experiencing the "old" day, such as April 11, and the areas of the World experiencing the "new" day, such as April 12.

The instant of noon at the Prime Meridian, indicated by the London extension 44, coincides with the instant of midnight in the Fiji Islands and New Zealand, indicated by the alignment of Date Line extension 46 with the midnight mark 52*a* on the ring 51. At this instant the old day, April 11, ends and the entire Earth experiences only a single day, April 12. The next second begins another new day, April 13, in the Fiji time zone.

It will be clear to those skilled in the art that the clock of FIGS. 3 to 5 can be modified, as stated, to customize the geographic hand member or radiant 41 in any desired manner to provide a visual representation of any desired continents or countries of the World and/or specific references to countries or cities shown in their correct geographic locations or time zones against a transparent background such as clear plastic. It will also be clear from FIG. 3 that the present clocks may comprise combinations of conventional hand clocks and digital clocks which include means for correlating the data shown by each type in order to provide a unitary display which gives the observer a visually recognizable picture of the time of day and date which coincide in different geographic areas of the World.

Figure 6:
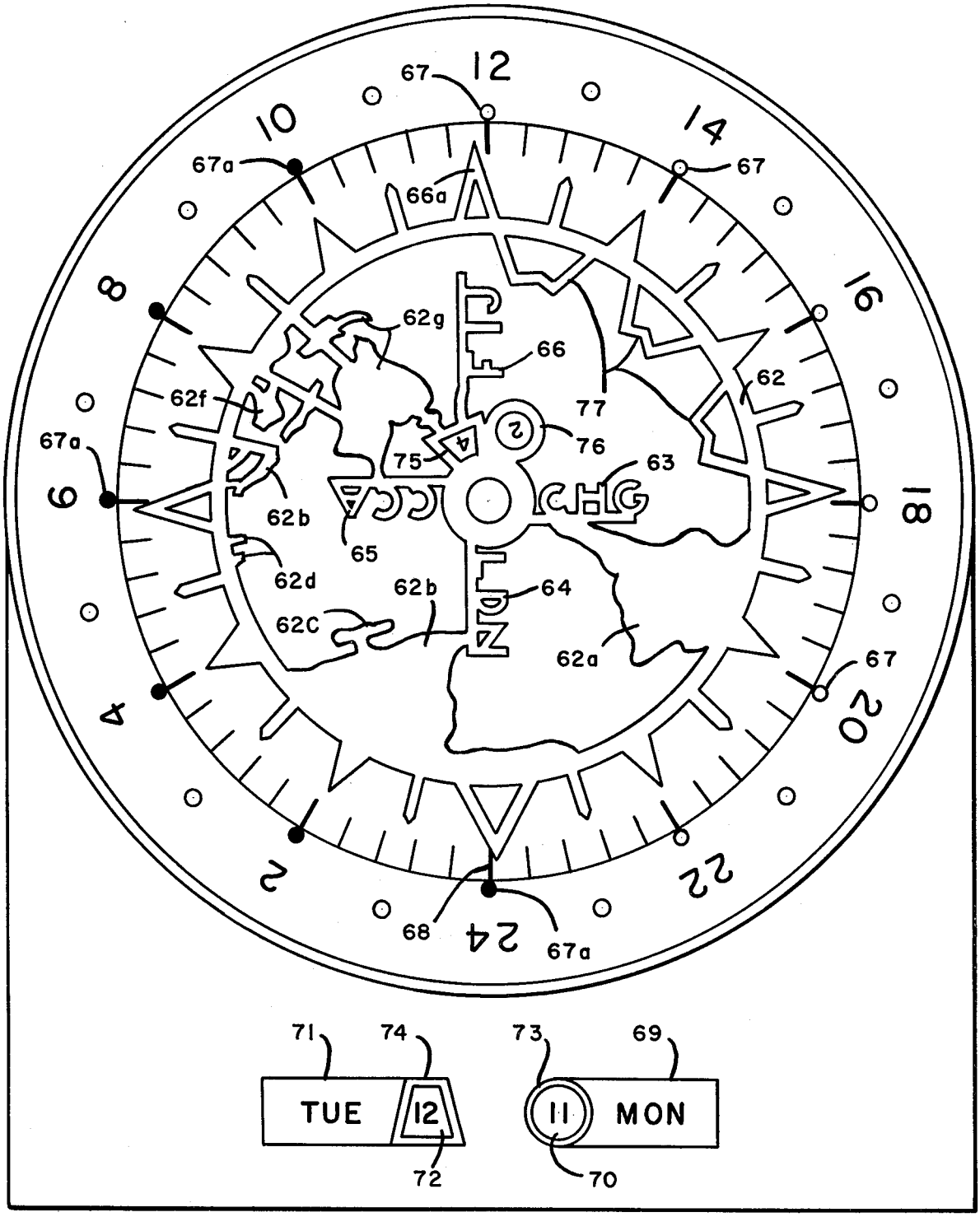
FIG. 6 is a front view of an electronic twenty-four hour date clock according to another embodiment of the present invention, and incorporating a digital display correlated to the clock radiant.

FIG. 6 illustrates another form of combined hand clock and digital calendar clock which provides the viewer with a visual representation of the time of day in various geographic areas of the Earth and also with a visual representation of the time of day in various geographic areas of the Earth and also with a visual representation of the geographic areas of the Earth which are experiencing the two different coincident calendar days and the day of the week and the calendar month for the new day in the Fiji time zone or in the local time zone, as desired. In FIG. 6, the radiant 62 comprises the continents or geographic areas 62*a* (South America), 62*b* (Africa), 62*c* (Malagasy Republic), 62*d* (India and Syrilanka), 62*e* (Sumatra), 62*f* (Borneo), 62*g* (Australia and New Guinea) and 62*h* (New Zealand), illustrated in a more southerly location than is accurate geometrically, for purposes of clarity and in order to include countries or portions of continents which do not exist in the Southern Hemisphere. Also, the radial support extensions 63, 64, 65 and 66 are designated as CHG (Chicago), LDN (London), CCA (Calcutta) and FIJ (Fiji), respectively. The latter extension 66 corresponds to the International Date Line.

In the embodiment of FIG. 6, the day-indicating means comprises a plurality of lights 67 and means for energizing and de-energizing said lights, starting from the 24-hour position on the dial, with each movement of the International Date Line extension 66 past said 24-hour position line 68. In this manner, all of the lights 67 will be in the same state at the instant of midnight, Fiji time to provide a clear visual indication that the entire Earth is experiencing the same day. However, as the Fiji extension 66 is rotated clockwise beyond the 24-hour position line 68, the lights 67 overtaken by the extension 66 are activated to a changed state 67*a*, i.e., energized or illuminated in the embodiment shown by FIG. 6, to provide a clear visual indication that the geographic areas on the radiant 62 encompassed by the lighted areas of the dial are experiencing the new day while the other areas of the Earth are still experiencing the old day.

The means for energizing and de-energizing the lights 67 may be varied depending upon the size of the clock and whether it is powered by battery or by house power. Reference is made to U.S. Pat. No. 2,169,208 for one suitable system by which all of the lights are deactivated at the desired hour, i.e., the 24-hour position in the present instance, and the lights are sequentially reactivated or illuminated in timed relation in the clockwise direction as they are overtaken by the Fiji extension 66.

FIG. 6 also includes a digital display of the day of the week 69 corresponding to the date 70 of the old day, the day of the week 71 corresponding to the date 72 of the new day, the date 70 of the old day being shown within the circular date symbol 73 symbolic of the old day and the date 72 of the new day being shown within the triangular date symbol 74 symbolic of the new day. The embodiment of FIG. 6 provides the viewer not only with a visual indication of the geographic areas of the World experiencing the new and the old days but also with a specific identification of the day of the week and date of both the new and the old days, namely Tuesday the 12th and Monday the 11th, respectively. At the moment after midnight, Fiji time, the dates 72 and 70 will each advance to "13" and "12", respectively, and the day displays 71 and 69 will advance to "WED" (Wednesday) and "TUES" (Tuesday), respectively, to illustrate the end of Monday, April 11, the nearly total World day of Tuesday, April 12, and the end of Tuesday, April 12, and the start of Wednesday, April 13, in geographic areas of the World located between the fixed twenty-four hour mark 68 on the lower part of the dial and the clockwise advance position of the moving pointer of the Fiji extension 66 of the radiant 62. Thus, after midnight of Tuesday, April 12, it becomes Wednesday, April 13, in the Fiji time zone, and in each time zone in the easterly or clockwise direction from the Fiji time zone or International Date Line which is overtaken by the pointer of the Fiji extension 66 as illustrated by the illuminated lights 67*a*. Concurrently, it is still Tuesday, April 12, in all of the other geographic areas of the World illustrated on the arc or portion of the radiant lying between the dial pointer 68 and the pointer of the Fiji extension 66 in the counterclockwise or westerly direction as illustrated by the non-illuminated lights 67. For example, at 1800 hours or 6:00 P.M. Fiji time, on Wednesday, April 13, it is 2400 hours or midnight Chicago time, on Tuesday, April 12. The radiant 62 of FIG. 6 also carries new day symbol 75 and old day symbol 76 in association with the Fiji extension 66, which symbols are correlated to the date symbols 74 and 73 of the digital display in the manner discussed hereinbefore in connection with symbols 26*a* and 27*a* of FIG. 1.

The same digital display and correlated day symbols are illustrated in the embodiment of FIG. 3 and, therefore, the same reference numerals are used therein and the pertinent description of the embodiment of FIG. 6 also applies to the embodiment of FIG. 3.

It will be clear to those skilled in the art that the digital display of the day and dates shown in FIG. 6 are controlled by conventional electrical or mechanical clock means which are well-known and which are synchronized with the chronometer mechanism or works of the hand clock in order to change displays after the instant of midnight, Fiji time, as indicated by the alignment of the pointer 66*a* of extension 66 and the 24-hour mark 68 of the clock dial. It will also be clear that the digital display can include a display of the month and/or year, if desired. Also, digital displays may be provided for the days and dates in local time zones.

The radiants 16 of FIG. 1, 41 of FIG. 3 and 62 of FIG. 6 also illustrate the integral fanciful initials WWW 77 which represent the trademark "Weller World Watch" for the novel clocks of the present invention.

In their most simplified form, the novel date clocks of the present invention comprise a fixed dial and a 24-hour geographic radiant having a pointer positioned at the International Date Line, which pointer is correlated with an advancing day-indicating means on the dial face, the latter providing a clear visual background indication of the portion of the dial face from the 24-hour position clockwise to the advancing position of the Date Line pointer of the radiant, thereby providing a clear visual indication of the portion of the Earth experiencing the new day as represented by the geographic areas on the radiant overlying or encompassed by the advanced portion of the day-indicating means. The advanced portion is clearly indicated by color contrast, light contrast or any other suitable means which advances in correlation with the advance of the Date Line pointer of the radiant. The fixed dial is provided with a midnight or 24-hour mark, the old day portion of the dial being located on the right side or western side of the midnight mark to define between its side of the midnight mark and the Date Line pointer of the radiant, in the counterclockwise direction, the geographic areas of the Earth, illustrated on the radiant, which are still experiencing the old day as clearly visually indicated by the changed indicia, color contrast or light contrast in that portion of the dial face. The new day portion of the dial is located on the left side or eastern side of the midnight mark and defines between its side of the midnight mark and the Date Line pointer on the radiant, in the clockwise direction, the geographic areas of the Earth, illustrated on the radiant, which are experiencing the new day as clearly visually indicated by the changed indicia, color contrast or light contrast in that portion of the dial face. As discussed hereinbefore, the day-indicating means of FIGS. 1 and 3 may be a shape or color contrast, as illustrated, or may take any other form in which they provide progressing, visually-distinguishable segments of the dial face.

The radiants 16, 41 and 62 illustrated by FIGS. 1, 3 and 6 may be fabricated from any desired material, such as metal, plastic or the like. Most preferably, they are formed from lightweight materials so as to be easily rotatable by means of conventional chronometer works, particularly in the case of wristwatches. For example, the radiants can be formed from thin gauge gold, nickel or other metal which can be etched to partially or completely remove portions, illustrated by the drawing, as spaced interconnected portions or as raised or polished portions against contrasting etched and dull recessed portions. Alternatively, the radiants may be formed of thin, lightweight plastic which is printed, solvent-etched or metallized with the desired geographic continents, date line extensions and peripheral pointers.

Variations and modifications of the present invention will be apparent to those skilled in the art within the scope of the present claims.

I claim:

1. A date clock comprising a casing containing a chronometer mechanism comprising at least one central axial shaft which is adapted to make one complete clockwise revolution every twenty-four hours, a dial on said casing having a central opening, a geographic hand member attached to said shaft through said central opening of the dial and extending parallel to and closely spaced from the surface of said dial for 360° rotation with said shaft around said dial, said hand member comprising indicia of geographic areas of the Earth in various geographically-accurate radial directions relative to the axis of rotation of said hand member which coincides with the axis of rotation of the Earth, and at least one date pointer means adjacent an extremity of said hand member and located in a geographically-accurate position relative to said geographic areas to indicate the time zone of the International Date Line, said dial comprising a fixed midnight mark which is located for alignment with said date pointer means of said hand member once during each twenty-four hour rotation of said hand member to coincide with the end of the old calendar day and start of another new calendar day in the time zone of the International Date Line, and day-indicating means comprising means for changing the visual appearance of at least a portion of said dial from said midnight mark in the clockwise direction in correspondence with the movement of the date pointer means, said clock providing a visual indication of said geographic area indicia present on said hand member in the clockwise portion thereof located between the fixed midnight mark on the dial and the date pointer means, the corresponding portion of said dial being visually distinguished from the remainder of said dial by the changed portion of said day-indicating means, and geographic area indicia present on said hand member in the counter clockwise portion thereof located between the midnight mark on the dial and the fixed pointer means on said hand member, the corresponding portion of said dial being visually distinguished from the remainder of said dial by the unchanged portion of said day-indicating means.

2. A date clock according to claim 1 in which the visually-distinguishable day-indicating means present on said dial comprises a portion of said dial which changes color from said midnight mark in the clockwise direction to correspond with the clockwise movement of the date pointer means of said hand member.

3. A date clock according to claim 2 in which said portion of said dial which changes color comprises a flexible colored disk which is attached to said central shaft for rotation with said geographic hand member and in spaced relation between said hand member and said dial, said disk having a radial slot in a location corresponding to the location of the date pointer means on said hand member, said dial having a radial slot in a location corresponding to said fixed midnight mark, and means for causing the edge of said disk, beyond the radial slot therein, to be deflected into and out of the radial slot in the dial during successive rotations of said disk to cause its position to be alternated in front of an behind said dial during successive rotations.

4. A date clock according to claim 1 in which the visually-distinguishable day-indicating means present on said dial comprises a portion of said dial which changes illumination from said midnight mark in the clockwise direction to correspond with the clockwise movement of the date pointer means of said hand member.

5. A date clock according to claim 4 which comprises a plurality of spaced light means, one each associated with a fixed hour position on said dial, and means for activating each said light means sequentially in coincidence with the movement of the date pointer means of said geographic hand member to each said hour member.

6. A date clock according to claim 1 in which the visually-distinguishable day-indicating means comprises a plurality of spaced pivot members, each associated with a fixed hour position on said dial and pivotable between visually-distinguishable positions, means associated with the rotation of said geographic hand member to cause each of said pivot members to pivot from one position to the other sequentially in coincidence with the movement of the date pointer means of said hand member to each said hour position.

7. A date clock according to claim 6 which further comprises means for repivoting all of said pivot members back to their original positions simultaneously when said date pointer means of said hand member moves to the fixed midnight mark on said dial.

8. A date clock according to claim 7 in which said means for repivoting said pivot members comprises an annular cam ring on said dial which engages each of said pivot members and means associated with the rotation of said hand member for rotating said cam ring to repivot each of said pivot members when the date pointer means of said hand member passes the fixed midnight mark on said dial.

9. A time and date clock according to claim 1 in which said hand member also contains area indicator points at extremities thereof which are in radial alignment with said geographic area indicia to indicate the time zones in which said geographic areas are located, and said dial comprises twenty-three hour indicia which are evenly spaced from each other and from said midnight mark around the periphery of said dial, the alignment of said area indicator points of said hand member and said hour indicia of said dial providing a visual indication of the local hour in each of said geographic areas.

10. A time and date clock according to claim 9 in which the chronometer mechanism within the casing of the clock also comprises a coaxial shaft which is adapted to make one complete clockwise revolution every sixty minutes, a minute hand attached to said coaxial shaft, extending parallel to and closely spaced from said geographic hand member and having a minute-indicator point adjacent an extremity thereof, and said dial comprises sixty minute indicia, which include said twenty-three hour indicia and said midnight mark, evenly spaced from each other around the periphery of said dial, the alignment of said minute-indicator point with said minute indicia of said minute hand providing a visual representation of the number of minutes which have expired since the previous hour in any geographic area of the World.

11. A twenty-four hour date clock according to claim 1 or claim 9 in which said geographic hand member comprises a circular map member comprising recognizable outlines of at least portions of some of the continents of the Earth.

12. A twenty-four hour date clock according to claim 11 in which said geographic hand member also comprises a local hour pointer which is manually-positionable on said hand member to indicate the hour in any local time zone relative to Greenwich Mean Time.

13. A twenty-four hour date clock according to claim 1 which further comprises digital displays of the numerical values of the new day and of the old day, which displays automatically change to coincide with the end of one day and the beginning of another new day at the International Date Line time zone.

14. A twenty-four hour date clock according to claim 13 which further comprises a visual display of the day of the week corresponding to the new day.

15. A twenty-four hour date clock according to claim 13 which further comprises a visual display of the day of the week corresponding to the old day.

16. A twenty-four hour date clock according to claim 1 in which said dial comprises a manually-rotatable annular ring carrying said twenty-three hour indicia and said midnight mark, said ring being adjustable so that said midnight mark can be aligned with any desired physical position on the clock.

17. A twenty-four hour time and date clock comprising a casing containing a chronometer mechanism comprising two central coaxial shafts which are adapted to make one complete clockwise revolution every twenty-four hours and every sixty minutes, respectively, a dial on said casing having a central opening, a circular geographic hand member attached to said twenty-four hour shaft through said central opening of the dial and extending parallel to and closely spaced from the surface of said dial for 360° rotation with said shaft around said dial, said hand member comprising indicia of geographic areas of the Earth corresponding to the Southern Hemisphere in various geographically-accurate radial directions relative to the axis of rotation of said hand member which coincides with the axis of rotation of the Earth, and a plurality of peripheral pointer means adjacent the extremity of said hand member, one said pointer means being a date pointer located in a geographically-accurate position relative to said geographic areas to indicate the time zone of the International Date Line, said dial comprising a midnight mark which is located for alignment with the pointer means of said geographic hand member once during each twenty-four hour rotation of said hand member to coincide with the end of the old calendar day and start of another new calendar day in the time zone of the International Date Line, a day-indicating means on said dial which advances in the clockwise direction in association with the movement of the date pointer of said hand member starting at said midnight mark to provide a changed visually-distinguishable portion of said dial, said clock providing a visual indication of geographic areas of the Earth experiencing the new day, comprising the geographic area indicia present on said geographic hand means in the clockwise portion thereof located between the midnight mark on the dial date pointer on said hand member, as indicated by the changed, visually-distinguishable portion of said dial, and geographic areas experiencing the old day, comprising the geographic area indicia present on said hand means in the counterclockwise portion thereof located between the midnight mark on the dial and the date pointer means of said hand member as indicated by the unchanged portion of said dial, a minute hand attached to the one of said coaxial shafts which is adapted to make one complete clockwise revolution every sixty minutes, said minute hand extending parallel to and closely spaced from said circular geographic hand member and having a minute-indicator point adjacent an extremity thereof, and sixty minute indicia, which include said twenty three hour indicia and said midnight mark, evenly spaced from each other around the periphery of said dial, the alignment of said minute-indicator point with said minute indicia of said minute hand providing a visual representation of the number of minutes which have expired since the previous hour in any geographic area of the World.

* * * * *